US005890890A

United States Patent [19]

Groom

[11] Patent Number: 5,890,890

[45] Date of Patent: Apr. 6, 1999

[54] KILN ASSEMBLY

[75] Inventor: Bryan Groom, Stoke-on-Trent, United Kingdom

[73] Assignees: Bryan Groom Limited, Stoke-On-Trent; Camlaw Limited, Tamworth, both of United Kingdom

[21] Appl. No.: 711,361

[22] Filed: Sep. 4, 1996

[30] Foreign Application Priority Data

Jan. 25, 1996 [GB] United Kingdom ..... 9601483

[51] Int. Cl.[6] ..... F27B 9/10; F27B 9/20; F27D 3/02

[52] U.S. Cl. ..... 432/121; 432/126; 432/234; 432/239

[58] Field of Search ..... 432/241, 234, 432/239, 243, 246, 121, 126, 137, 141

[56] References Cited

U.S. PATENT DOCUMENTS

| | | | |
|---|---|---|---|
| 4,348,175 | 9/1982 | Molina | 432/241 |
| 4,421,481 | 12/1983 | Holz et al. | 432/137 |
| 4,609,345 | 9/1986 | Schroder et al. | 432/137 |
| 4,778,383 | 10/1988 | Strobel et al. . | |
| 4,778,384 | 10/1988 | Lingl, Jr. | 432/241 |
| 4,929,177 | 5/1990 | Paul | 432/241 |
| 5,112,223 | 5/1992 | Walle et al. | 432/241 |
| 5,605,455 | 2/1997 | Melotti | 432/246 |

FOREIGN PATENT DOCUMENTS 2 161 252 1/1986 United Kingdom .

*Primary Examiner*—Teresa Walberg
*Assistant Examiner*—Gregory A. Wilson
*Attorney, Agent, or Firm*—Smith-Hill and Bedell

[57] ABSTRACT

A kiln assembly (10) with a tunnel kiln (12) having an entrance (14) and exit (16). Two parallel guideways (18) are provided extending through the kiln (12), each adjacent a side wall of the kiln (12). A plurality of car members (20) are movable respectively along either of the guideways (18) carrying support members (24) extending therebetween. Ware is loaded on to the support members (24) at the entrance (14), and is unloaede at the exit (16), are provided. Return guideways (22) are provided extending around opposite sides of the kiln (12) such that the car members (20) from the respective guideways (18) pass around opposite sides of the kiln (12) in a different spacing from when travelling through the kiln (12).

40 Claims, 10 Drawing Sheets

KILN ASSEMBLY

FIELD OF THE INVENTION

This invention concerns a kiln assembly and particularly but not exclusively such an assembly for firing ceramic articles; and also a kiln.

BACKGROUND OF THE INVENTION

In conventional tunnel kilns for firing ceramic and similar articles, a plurality of kiln cars are provided running on tracks through the kiln and on a return track from the kiln exit to the kiln entrance. The kiln cars comprise a considerable amount of refractory material required to inter alia protect the wheels upon which the car travels. Accordingly, a large amount of heat applied in the kiln is used in heating up the initially cold kiln cars rather than firing the ware carried by the cars. Furthermore, a considerable amount of space is required for the return track for the kiln cars. Also, kiln cars can be relatively difficult to load and unload thereby providing for a high labour requirement and also a relatively high risk of damage to items being fired.

SUMMARY OF THE INVENTION

According to the present invention there is provided a kiln assembly, the assembly comprising: a kiln through which articles to be fired can be moved from an entrance at one end to an exit at the other end; at least two spaced parallel guide means extending through the kiln from the entrance to the exit; a plurality of discrete car members movable through the kiln along either of the guide means, the car members being arranged such that support means can be provided extending between car members in respective different guide means for supporting thereon articles to be fired; return guide means for the car members from the kiln exit to the kiln entrance, the spacing of the return guide means being other than the spacing of the guide means in the kiln; loading means at or adjacent the kiln entrance for loading the support means on to respective car members to extend therebetween; and unloading means at or adjacent the kiln exit for unloading the support means from the car members.

Means are preferably provided for moving the car members through the kiln. The moving means for adjacent guide means are preferably indexed such that car members in adjacent guide means move through the kiln in a parallel alignment.

The guide means preferably includes tracks, which tracks are desirably located beneath the kiln floor with openings extending thereabove through the kiln floor such that the car members extend through the kiln floor. The tracks may be in the form of rails.

The moving means may include wheels. Alternatively the car members may be slidable along the guide means. The guide means may comprise a plurality of freely rotatable transversly aligned rollers.

The moving means may be arranged such that consecutive car members on the same guide means locate adjacent each other but not in contact. The ends of the car members may be arranged such that a labyrinth seal is provided between adjacent non-contacting car members on the same guide means.

The moving means may comprise an endless line means located beneath the kiln and engageable with the car members to move same through the kiln. A plurality of endless line means may be provided, desirably one for each guide means. A plurality of spaced pusher members engageable with respective car members may be provided on the line means, the pusher members may extend between two or more adjacent line means.

Alternatively the moving means may comprise a plurality of driven rollers along the length of the kiln and therebeneath, the rollers being engageable with the car members. A plurality of sets of driven rollers could be provided across the width of the kiln.

The openings through the kiln floor and the respective parts of the car members which extend therethrough may be shaped so as to provide a labyrinth seal therebetween.

The support means may include a plurality of beams of refractory material and perhaps silicon carbide. Ware supports may be provided locatable on one or more of the refractory beams. The return guide means may be provided extending on both sides of the kiln such that some of the car members pass around one side of the kiln and others pass around the other side.

The floor of the kiln, or at least the part thereof between the outer most guide means, is preferably formed from a plurality of sections along the length of the kiln. Means are preferably provided to permit the kiln floor to be moved relative to the rest of the kiln. The floor sections may be mounted on wheels engageable on tracks.

The assembly preferably also comprises storage means locatable adjacent the entrance and/or exit of the kiln for respectively providing ware for firing in the kiln or receiving fired ware from the kiln.

The storage means are preferably cooperable respectively with the loading and/or unloading means. The storage means are preferably mobile and desirably can accept a plurality of support means located at different heights thereon.

Heating means may be provided on or immediately above the kiln floor for providing heat from beneath the ware. The heating means may be in the form of electric heating elements.

Passages are preferably provided extending through any of the kiln floor, kiln walls or kiln ceiling, for at least part of the length of the kiln. The passages preferably extend from the exit of the kiln. Fans may be provided substantially at the exit of the kiln or externally of the kiln for blowing air through said passages from outside of the kiln. The passages may connect with combustion means for the kiln such that air can be blown through the kiln floor, walls and/or ceiling, and heated by virtue of the high temperatures within the kiln, with the heated air being supplied to the combustion means.

Alternatively or in addition, the passages may extend to adjacent the kiln entrance to permit warmed air to be blown on to articles entering the kiln.

As a further alternative, passages may extend externally from the kiln whereby the warmed air may be used for heating, drying or another purpose.

Valve means may be provided to enable control of air flow through the respective passages.

The invention also provides a kiln comprising passages extending through the kiln floor, walls and/or ceiling as defined in any of the preceding four paragraphs.

Embodiments of the present invention will now be described by way of example only.

DESCRIPTION OF THE PREFERRED EMBODIMENTS OF THE INVENTION

Figure 1:
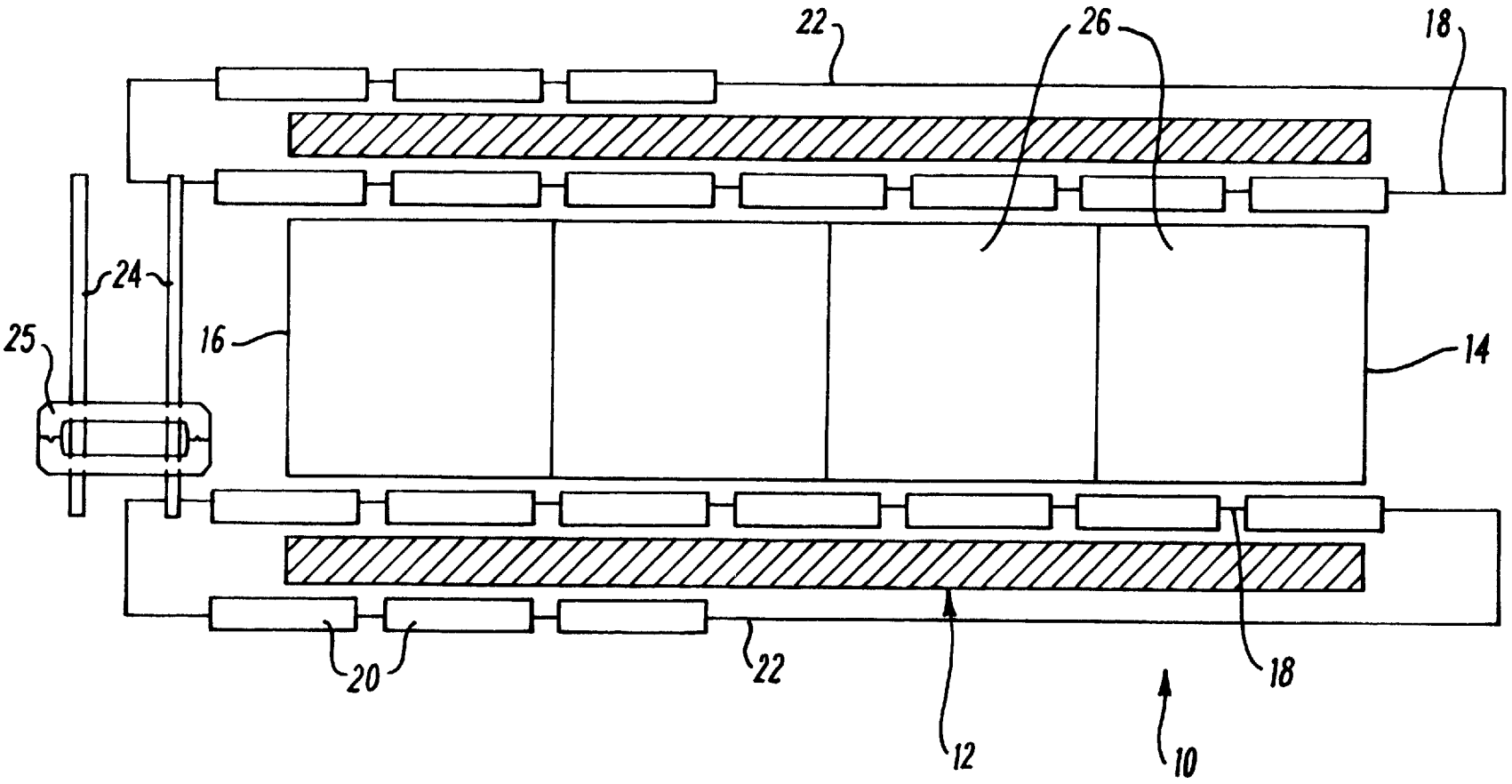
FIG. 1 is a diagrammatic plan view of a kiln assembly according to the invention.

FIG. 1 shows a first kiln assembly 10 according to the invention comprising a tunnel kiln 12 with an entrance 14 and exit 16. Two parallel guideways 18 are provided extending through the kiln 12, each adjacent a side wall of the kiln 12. A plurality of car members 20 are provided movable through the kiln 12 and around the outside thereof on respective return guideways 22. Only some of the car members 20 are shown in FIG. 1 for clarity. The return guideways 22 for each guideway 18 extend around the kiln 12 adjacent the respective side wall thereof which is adjacent the respective guideway 18.

A plurality of support members in the form of silicon carbide beams 24 are provided, but with only two thereof shown in FIG. 1. A pair of beams 24 are locatable extending between each respective pair of car members 20 located in the respective guideways 18 so as to support items of ware passing through the kiln. Ware supports 25, one only of which is shown as an example, can be located on the beams 24. Means for loading the beams 24 and items of ware supported thereon on to the respective car members 20 are provided adjacent the entrance 14 but not shown in FIG. 1. Corresponding unloading means (also not shown in FIG. 1) are provided adjacent the exit 16 for removing the beams 24 and load thereon from the car members 20 prior to the car members being rotated onto the return guideways 22. The car members 20 are arranged so as to move through the kiln in an indexed manner whereby to maintain a parallel alignment.

Figure 2:
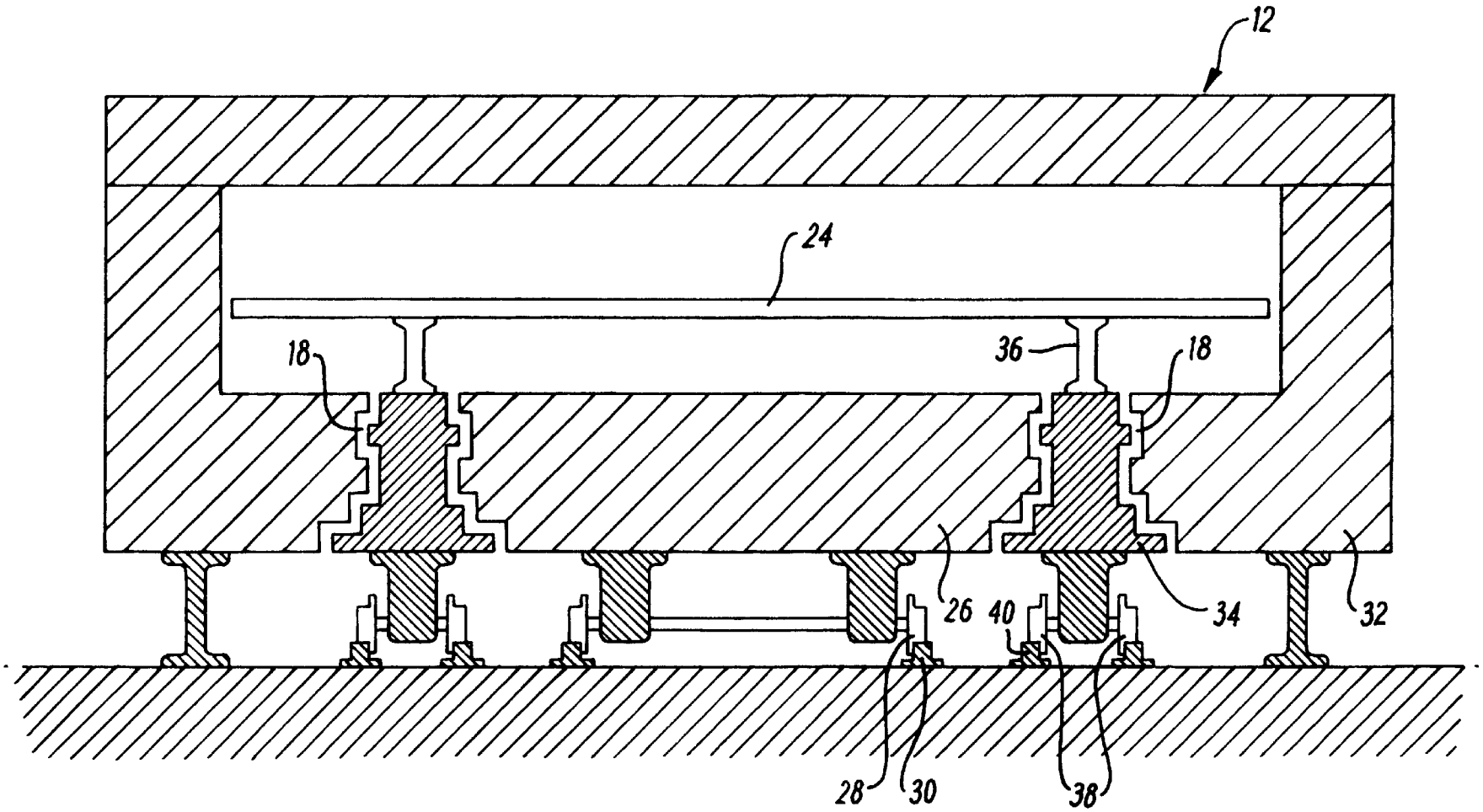
FIG. 2 is a cross-sectional view through the assembly of FIG. 1.

FIG. 2 shows the assembly 10 in more detail. The floor 26 of the kiln 12 between the guideways 18 is mounted on a pair of wheels 28 engageable on tracks 30 on the ground therebeneath. The floor 26 is provided in a number of sections as shown in FIG. 1. The sectional arrangement of the floor 26 with the wheels 28 permits one or more sections thereof to be moved out of the kiln for inspection, repair or maintenance. The guideways 18 are defined by spaces between the floor 26 and small portions of floor projections 32 extending from each of the side walls of the kiln 12.

Each car member 20 comprises a body 34 made of refractory material. Projections 36 extend upwardly from the body 34 upon which the beams 24 can be located. The sectional profile of the projections 36 comprises a plurality of steps which correspond to steps in the guideways 18 to provide a labyrinth seal between the bodies 34 and the kiln 12. A pair of outwardly facing wheels 38 are mounted to extend below the body 34. The wheels 38 are engageable with rails 40 extending along the ground.

Figure 3:
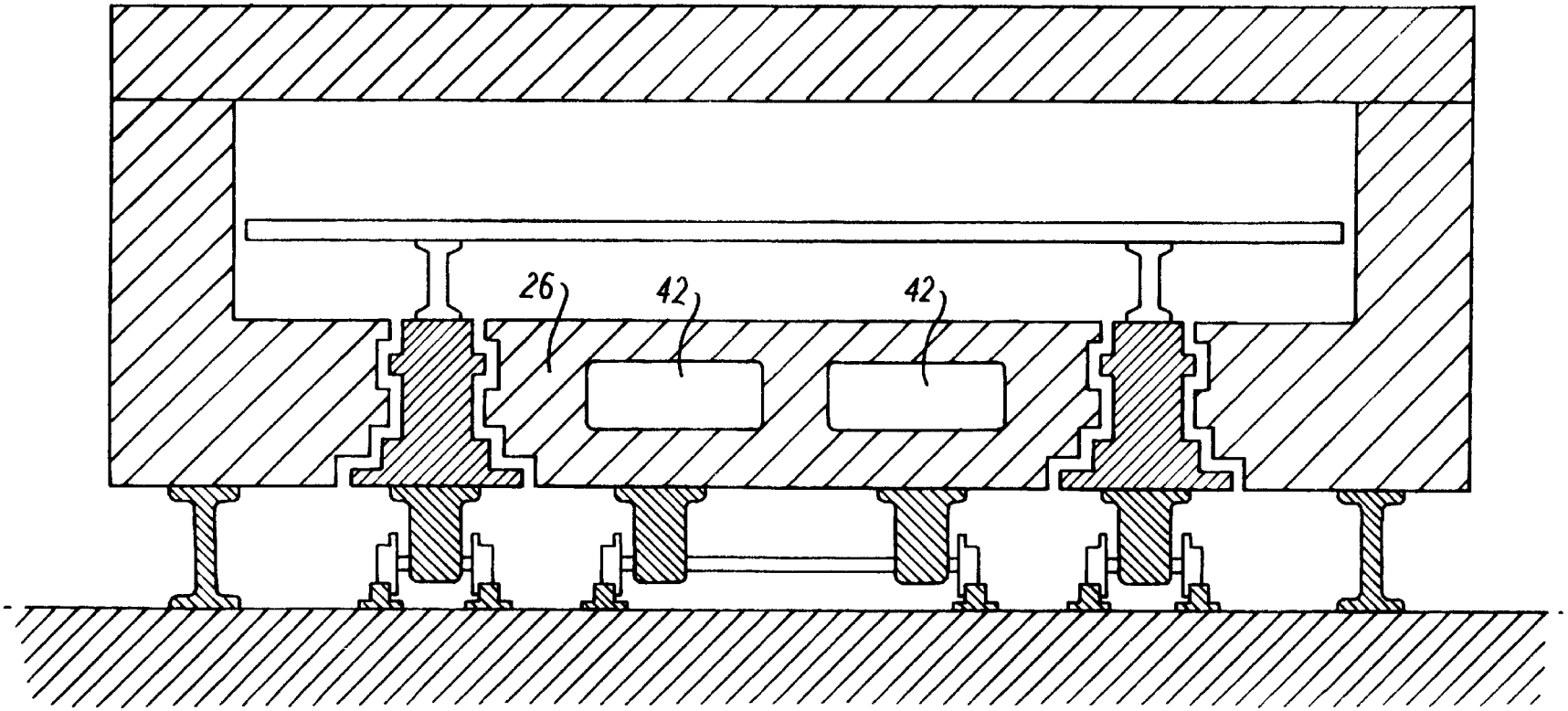
FIG. 3 is a similar view to FIG. 2 but at a different point.

Any suitable means may be provided for moving the car members 20 through the kiln 12. For instance, the car members 20 could abut each other and be periodically pushed by a hydraulic ram or other means from the entrance 14. Alternatively, an endless line means could be engageable with the underside of the bodies 34. For instance, a plurality of projections could be provided on the line means, each projection engageable with a respective car member 20. Synchronised line means may be provided for each guideway 18. With such an arrangement the car members 20 need not abut. In a preferred arrangement no contact is provided between adjacent car members but formations are provided on the end of each car member 20 so as to provide a labyrinth seal between adjacent members 20. FIG. 3 is a similar view to FIG. 2 except that passages 42 are provided through the floor 26 for a purpose hereinafter to be described.

As a further alternative a plurality of driven rollers are provided along the length of the kiln and therebeneath, with their axes transverse relative to the direction of movement through the kiln. A plurality of sets of rollers may be provided across the width of the kiln, with each set engageable with a respective line of car members 20. The rollers could be arranged in groups and driven by one or more motors through appropriate gearing.

Figure 4:
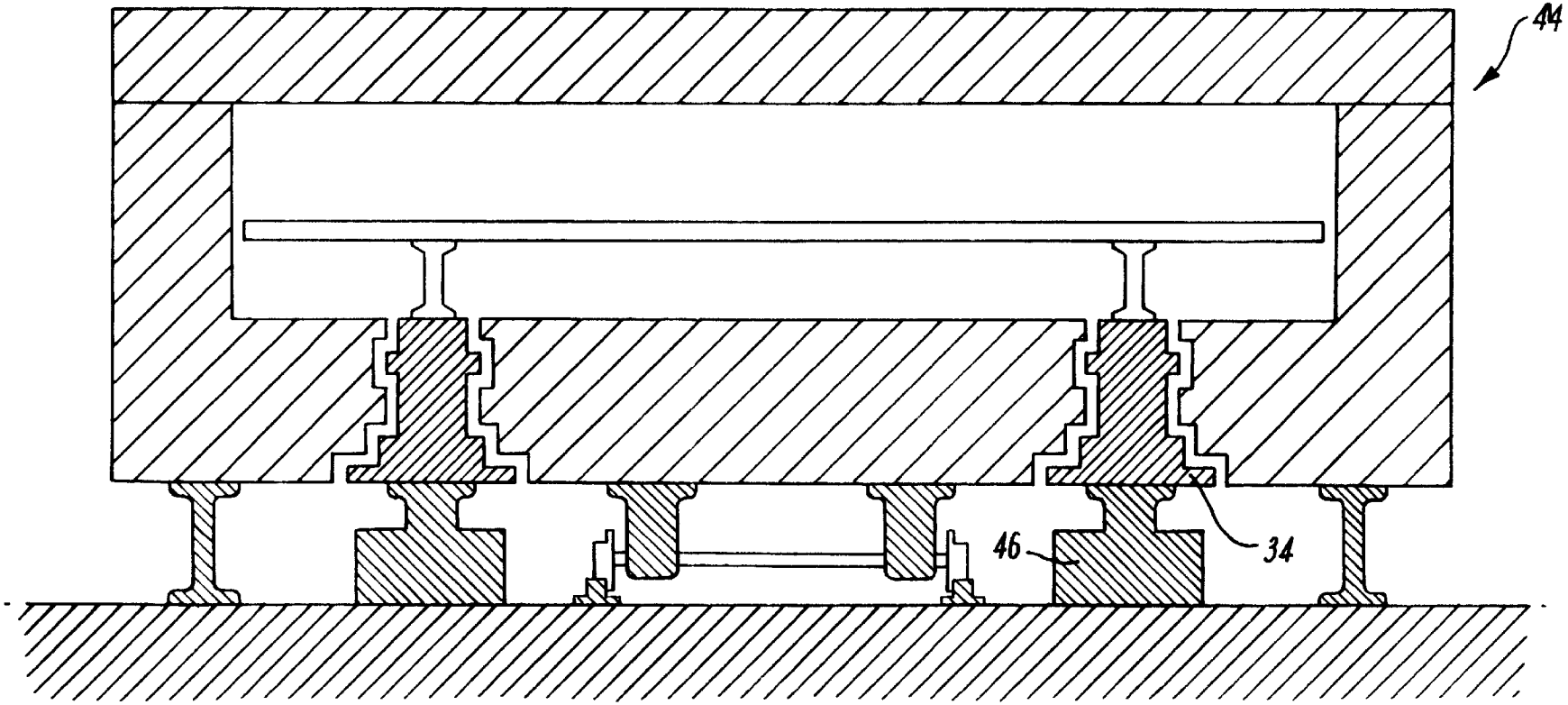
FIG. 4 is a similar view to FIG. 2 of a second assembly according to the invention.

FIG. 4 shows a similar second assembly 44. In the assembly 44 no wheels are provided on the underside of the bodies 34. Instead the bodies 34 are movable over a projecting member 46 upstanding from the ground. A plurality of freely rotatable transverse rollers may be provided on the member 46 to permit the body 34 to move thereover.

Figure 5:
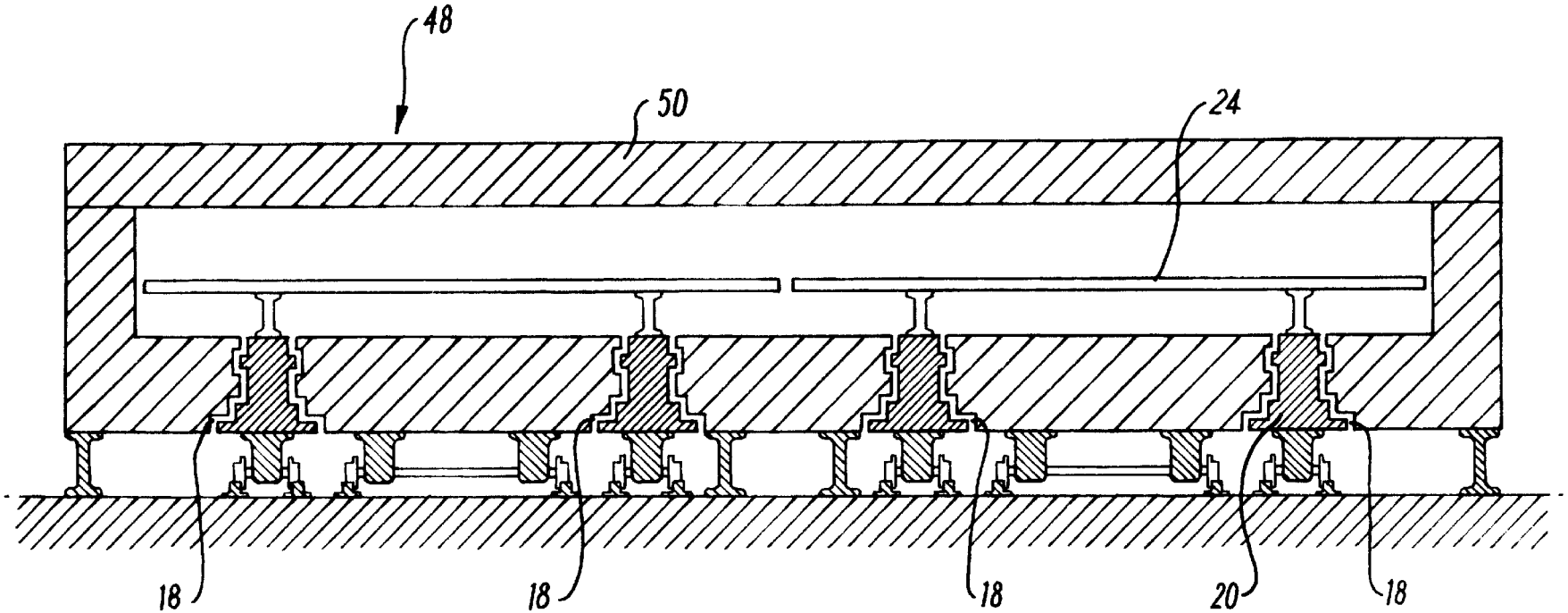
FIG. 5 is a similar view to FIG. 2 of a third assembly according to the invention.

FIG. 5 shows a further kiln assembly 48. The kiln 50 of the assembly 48 is wider than the kiln 12. Four guideways 18 are provided through the kiln 50. The members 20 movable through the guideways 18 permit two pairs of beams 24 to be supported across the kiln 12, with each pair adjacent the other pair. It is to be realised that any size of kiln can be produced according to the invention with an appropriate number of guideways to support the beams 24 and hence load thereon.

Figure 6:
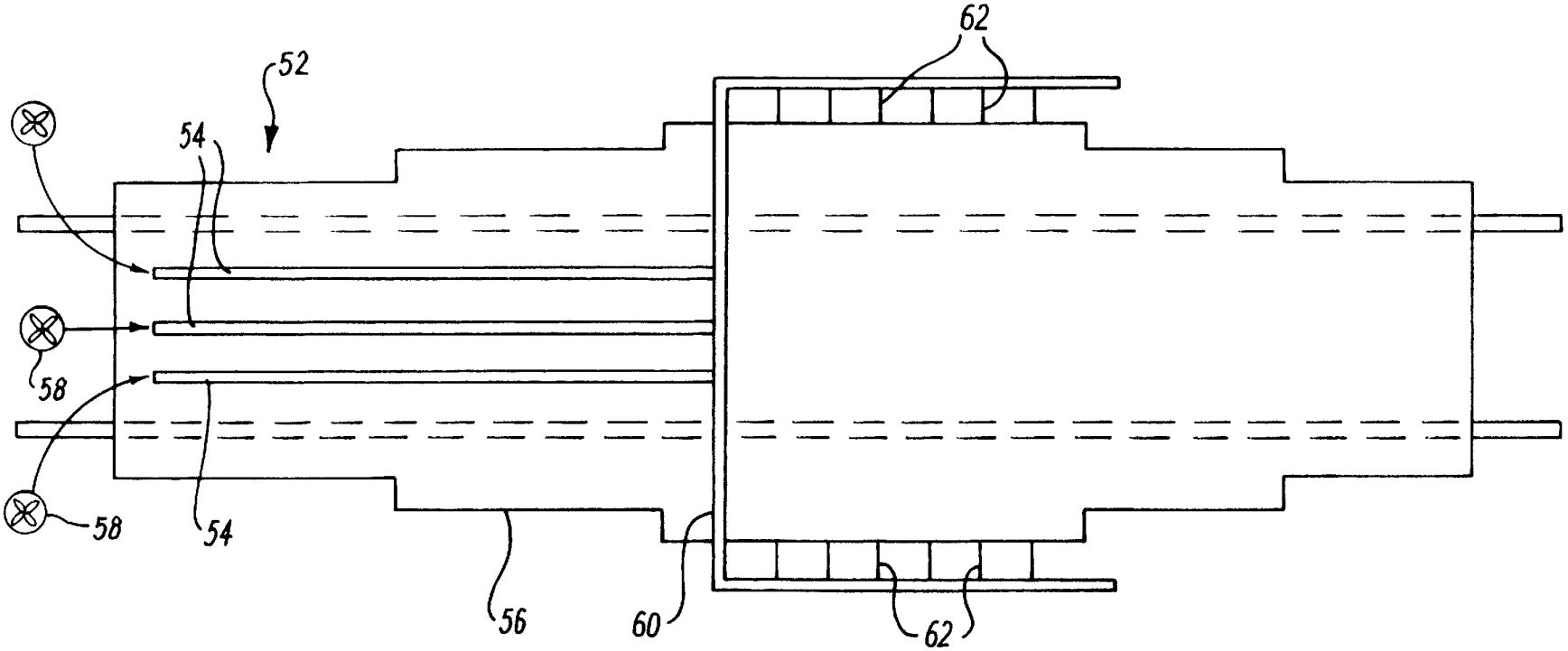
FIG. 6 is a diagrammatic plan view of a fourth assembly according to the invention.

FIG. 6 shows a fourth kiln assembly 52 which has a generally similar configuration to the assembly 10. Three passages 54 similar to the passages 42 extend through the floor 32 from the exit end of the kiln 56. A fan 58 is provided adjacent the beginning of each passage 54 for blowing fresh air thereinto. The passages 54 extend to the exit end of the main heating zone of the kiln 56 where they interconnect via a transverse passage 60. The passage 60 extends to either side of the kiln 56 to direct air blown through the passages 54 to provide combustion air for the burners 62. When the kiln 56 is operational the air passing through the passages 54 will become heated thereby improving combustion conditions and also removing a certain amount of heat from the cooling part of the kiln.

Figure 7:
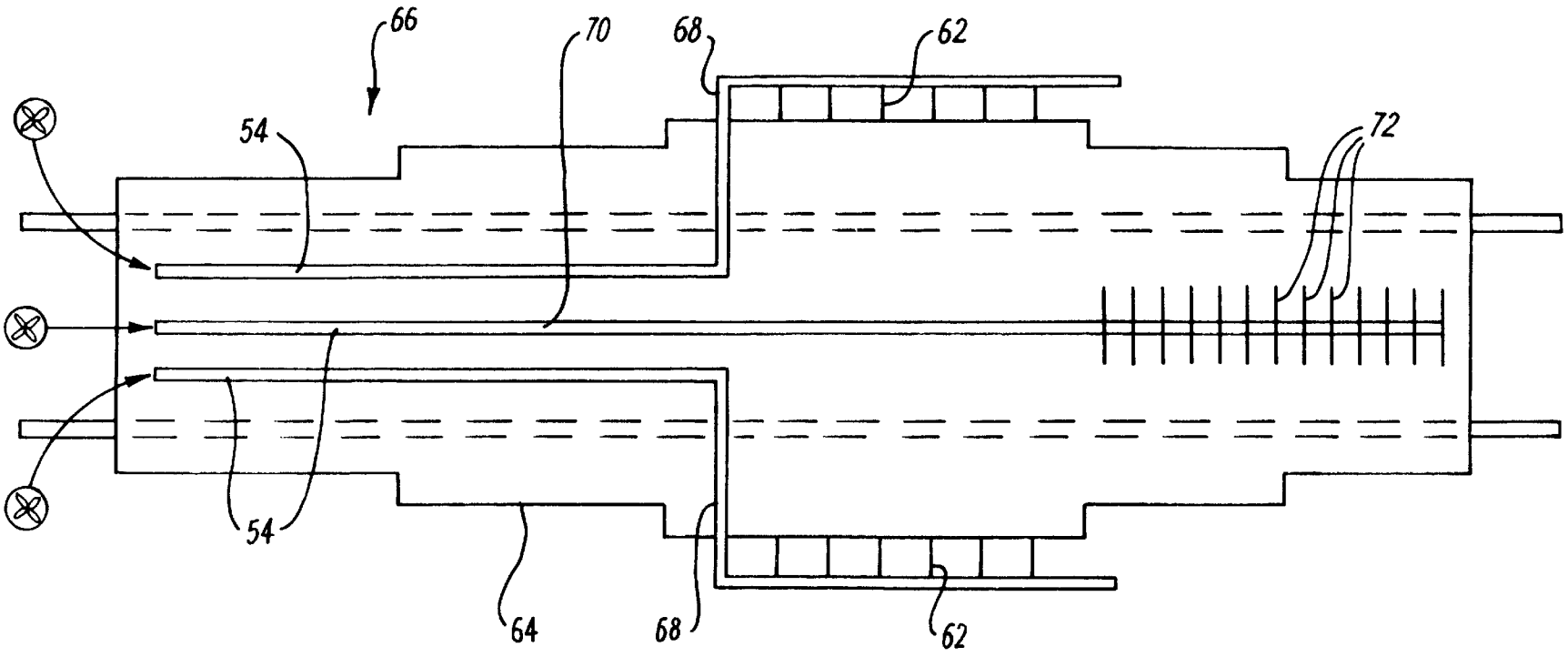
FIG. 7 is a similar view to FIG. 6 of a fifth assembly according to the invention.

FIG. 7 shows a similar arrangement to FIG. 6 but in the kiln 64 of the fifth assembly 66 shown in FIG. 7 the three passages 54 do not interconnect at the beginning of the main heating zone. Instead the outer passages 68 extend to the respective burners 62. The central passage 70 continues almost to the entrance end of the kiln 64. A plurality of upwardly opening vents 72 extend from the passage 70 in the preheating part of the kiln 64 to allow air to pass upwardly through the floor 26. The air passing through the passage 70 will be warmed as it travels along the length of the kiln 64 such that the air passing through the vent 72 will be warm for drying/initial heating of ware in the kiln 64.

Dampers (not shown) may be provided in any or all of the passages to permit the flow of air to be controlled.

Figure 8:
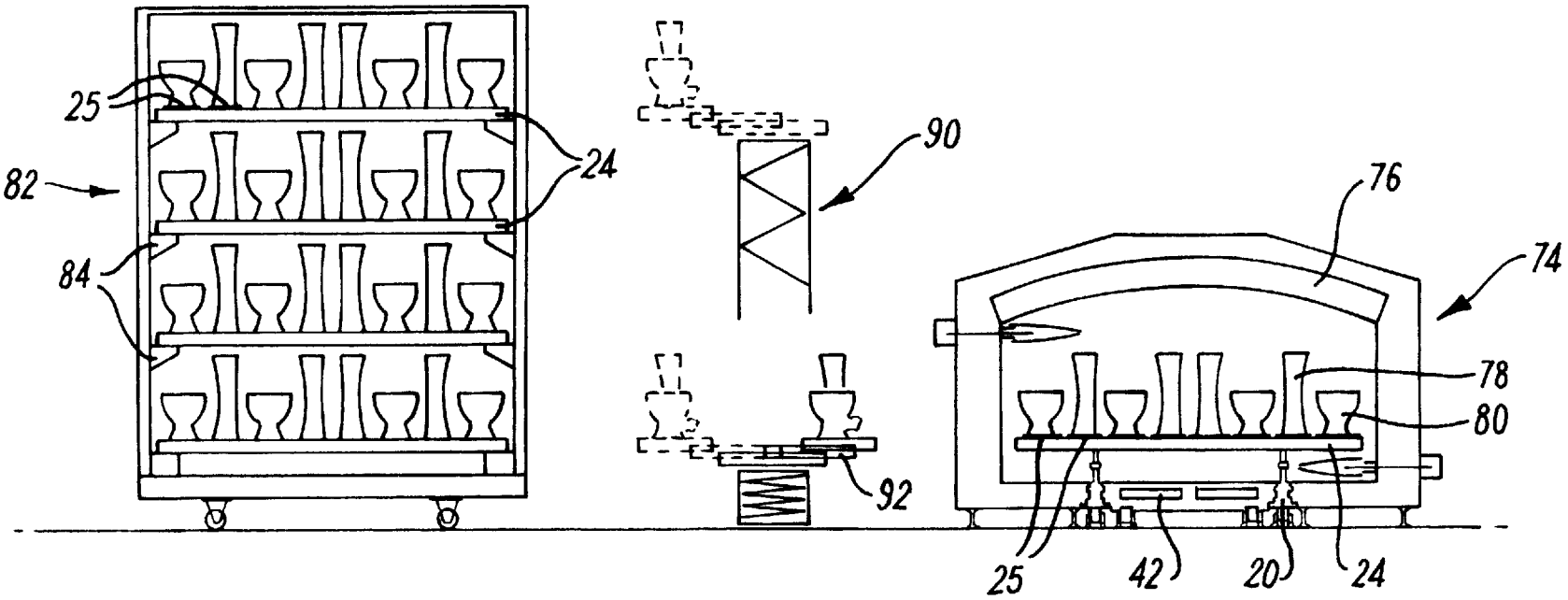
FIG. 8 is a diagrammatic side view of a sixth assembly according to the invention.

FIG. 8 shows a similar kiln 74 to the kiln 12 except that the kiln 74 has a higher domed roof 76. The kiln 74 is shown being used to fire items of sanitary ware, namely pedestals 78 and closets 80. The items of sanitary ware are supported on ware supports 25 only some of which are shown for clarity which are supported by a pair of beams 24. FIG. 8 also shows one of a plurality of mobile ware storage shelving units 82 used with the kiln 74. Each unit 82 comprises four layers of supports 84 upon which the pairs of beams 24 can be located. The shelving 82 will be used to bring items of unfired ware to the entrance of the kiln 74. Loading means 90 in the form of a pair of tines 92 which can be rotated and moved vertically are provided between the kiln 74 and unit 82. The loading means 90 can remove the loaded pairs of beams 24 from the shelving 82 as required and load them on to respective pairs of the car members 20. It will be noted that as the shelving 82 can carry four pairs of beams 24 this provides for a considerable saving in storage space required. Shelving units 82 would also be provided at the exit of the kiln 74 to receive fired ware on the beams 24 via unloading means which would be identical to the loading means 90.

Figure 9:
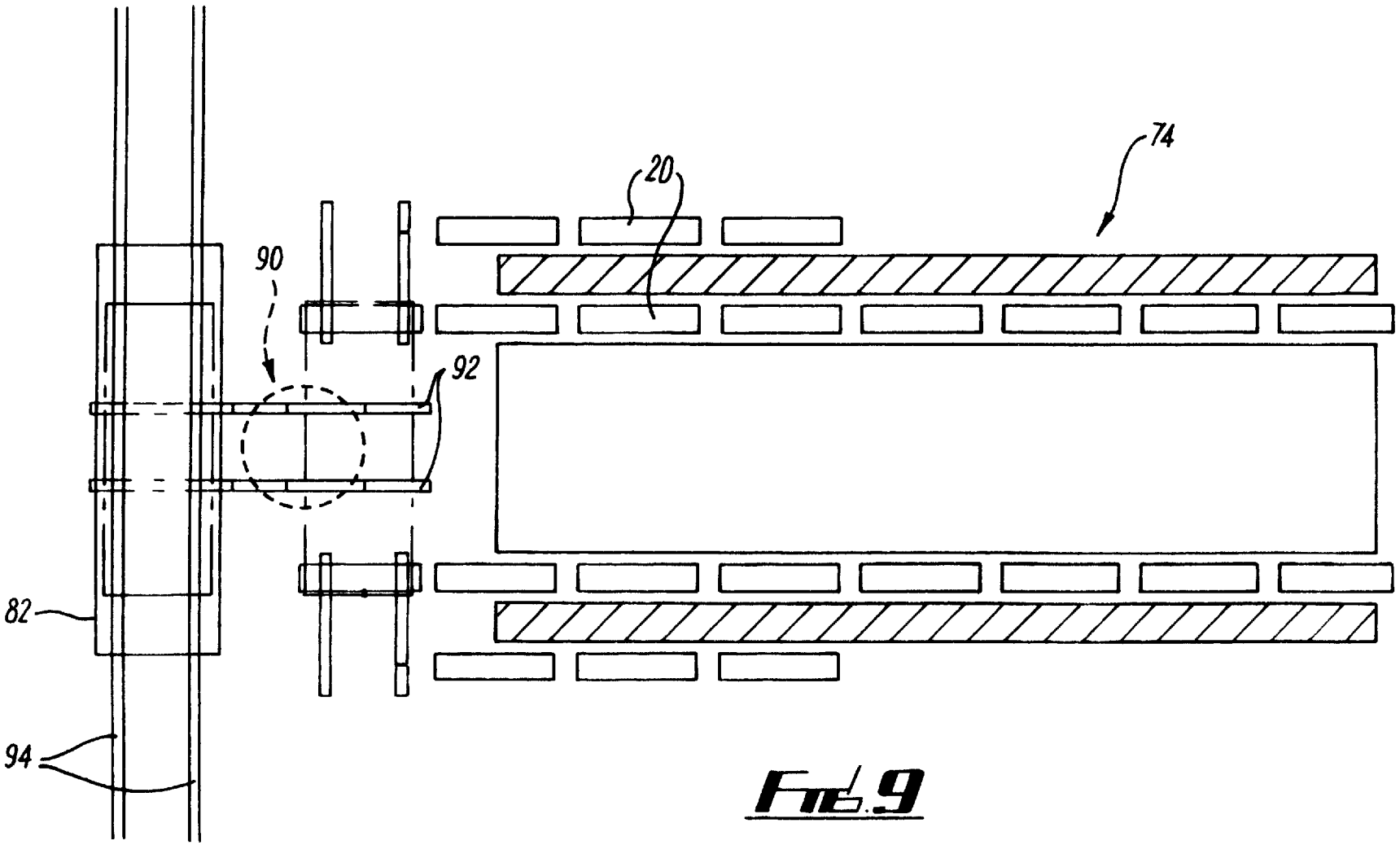
FIG. 9 is a diagrammatic plan view of a further part of the sixth assembly.

FIG. 9 shows the kiln 74 with the loading means 90 shown diagrammatically. A pair of rails 94 are provided for the units 82 to move along to deliver ware to the loading means 90. An identical arrangement (not shown) is provided at the kiln exit.

Figure 10:
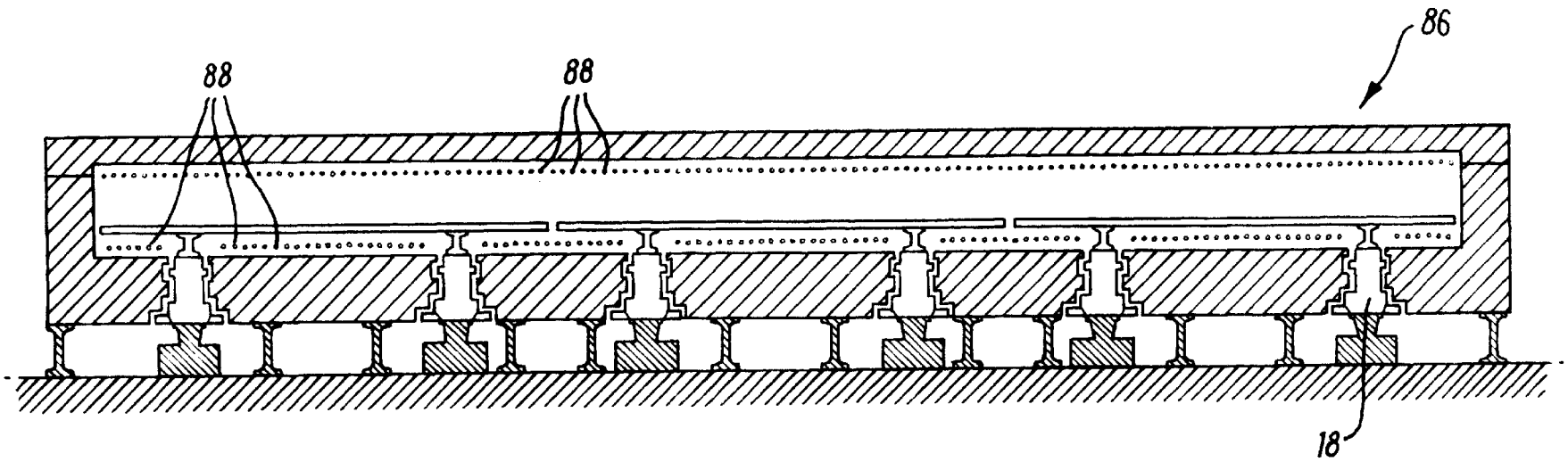
FIG. 10 is a diagrammatic cross-sectional view of seventh assembly according to the invention.

FIG. 10 shows a generally similar seventh assembly but with a wider kiln 86 with six guideways 18. A plurality of electric heating elements 88 are provided in the kiln 86. The elements 88 are provided on the ceiling of the kiln 86 and also along the floor thereof. This latter positioning enables heat to be applied to ware from below. Generally it is difficult to provide such heating in conventional kilns as a result of the kiln car structure. Whilst electric heating is described in this example any type of heating can be used in kilns according to the invention.

There are thus described kiln assemblies with a number of advantageous features. With assemblies according to the present invention, rather than conventional kiln cars which extend across substantially the whole width of the kiln, only two car members are required, and only part of these extend into the kiln interior. Accordingly, the amount of ware support items which are heated is considerably less than in conventional kilns, therefore providing significant savings in fuel costs. Conventional kiln cars require a considerable amount of refractory material to protect the wheels or other means which permit the cars to move through a kiln. In the present invention such insulation is provided by the floor of the kiln. As the floor of the kiln does not move through the kiln it does not require to be heated and then subsequently to cool each time as ware passes through the kiln, again therefore resulting in a saving in fuel costs. The arrangement of ware on beams in the present invention also permits heat to be applied the underside of the ware if required.

The arrangement of car members can be readily constructed, and with the indexing of the movement, safe carrying of ware through the kiln is achieved. Where the car members do not contact each other this reduces the possibility of ware being knocked off the supports or onto each other whilst in the kiln and therefore reduces the possibility of wastage during firing. The loading and unloading arrangements are particularly suited to mechanical arrangements thereby reducing labour costs and again the possibility of damage to ware. Also a saving in space can be achieved as the ware can be stored prior to loading and subsequent to unloading in a different arrangement than on the kiln car, thereby permitting ware to be stored to a greater height. With the car members a considerable space saving can be achieved as they do not need to travel from the exit of the kiln back to the entrance with the same spacing as in the kiln.

The possibility of removing the floor from the kiln for inspection, maintenance or repair can greatly ease these tasks, and obviously if a one part of the kiln floor became damaged this could be readily replaced. The sectional arrangement of the floor means that different levels of insulation can be used in the different part of the kilns. Accordingly, a much higher level of insulation is required in the main heating zone than in the cooling or the initial heating zone. With kiln cars, these all require to be able to stand the heat encountered in the main heating zone. Using the present system can therefore result in considerable cost savings as maximum insulation is only required in the main heating zone.

The above described systems of blowing air through the floor of the kiln also provides for considerable advantages. As the air is blown from at or near the kiln exit, conventional fans can be used which are not required to operate with hot air. In previous proposals hot air has generally been sucked from a kiln therefore requiring fans which can operate at very high temperatures and also generally providing for difficult working conditions for fans. The air blown in provides cooling where required. Also the air is heated. This air can be used to improve combustion conditions as described or for preheating ware entering the kiln. As an alternative, this heated air could be used externally of the kiln for other heating and/or drying purposes.

In addition or as an alternative, passages could similarly be provided through the kiln walls and ceiling, with air being blown through in the same manner. The air flow monitored and controlled, preferably automatically as conditions dictate.

Various other modifications may be made without departing from the scope of the invention. For example, cooling arrangements as outlined above could be used on kilns other than using the car members. Different cooling arrangements could be provided with an arrangement of passages appropriate to the kiln size and shape. The arrangement of the car members can be chosen to suit particular kilns and/or applications. Different methods may be used to move the car members through the kiln. Whilst in the above described examples labyrinth seals have been used to prevent heat loss between the kiln cars and each other or the kiln floor, other seals may be appropriate. Where more than two guideways are provided appropriate return guideways can be arranged. In certain instances all the return guideways may be provided on the same side of the kiln, though obviously the spacing between the guideways need not be the same as through the kiln.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A kiln assembly, the assembly comprising:

a kiln having a floor, walls, ceiling, one end defining an entrance and another end defining an exit;

at least first and second spaced parallel forward guide means extending through said kiln from said entrance to said exit;

at least first and second discrete car members;

means permitting said first and second car members to be movable together through said kiln from said entrance to said exit along said first and second forward guide means respectively;

support means for supporting articles of ceramic ware;

means provided on said first and second car members to permit said support means to extend between said first and second car members in said first and second forward guide means respectively for supporting articles to be fired relative to the first and second car members as said car members move through said kiln;

first and second return guide means for said car members, extending outside said kiln from said kiln exit to said kiln entrance, the spacing of said first and second return guide means being other than the spacing of said first and second forward guide means in said kiln;

loading means at or adjacent said kiln entrance for loading said support means on to said car members to extend therebetween;

and unloading means at or adjacent said kiln exit for unloading said support means from said car members.

2. An assembly according to claim 1, wherein moving means are provided for moving said car members through said kiln.

3. An assembly according to claim 2, wherein indexing means are provided for said moving means adjacent said guide means, such that said first and second car members in said first and second forward guide means respectively move through the said kiln in a parallel alignment.

4. An assembly according to claim 1, wherein said forward guide means includes tracks.

5. An assembly according to claim 4, wherein said tracks are located beneath said kiln floor, and openings are provided extending through said floor above said tracks such that said car members extend through said kiln floor.

6. An assembly according to claim 4, wherein said tracks are in the form of rails.

7. An assembly according to claim 2, wherein said moving means includes wheels.

8. An assembly according to claim 1, wherein means are provided to permit said car members to be slidable along said forward guide means.

9. An assembly according to claim 8, wherein said means permitting sliding comprises a plurality of freely rotatable transversly aligned rollers.

10. An assembly according to claim 1, comprising first and second groups of car members, the first group including said first car member and being movable through the kiln along said first forward guide means and the second group including said second car member and being movable through the kiln along said second forward guide means.

11. An assembly according to claim 2, wherein said moving means comprises an endless line means located beneath said kiln and engageable with said car members to move same through said kiln.

12. An assembly according to claim 11, wherein a plurality of said endless line means are provided.

13. An assembly according to claim 12, wherein one said endless line means is provided for each of said first and second forward guide means in said kiln.

14. An assembly according to claim 11, wherein a plurality of spaced pusher members engageable with respective said car members are provided on said line means.

15. An assembly according to claim 12, wherein a plurality of spaced pusher members engageable with respective said car members are provided on said line means, said pusher members extending between two or more adjacent said line means.

16. An assembly according to claim 2, wherein said moving means comprises a plurality of driven rollers along the length of said kiln and therebeneath, the rollers being engageable with said members.

17. An assembly according to claim 16, wherein a plurality of sets of said driven rollers are provided across said kiln.

18. An assembly according to claim 5, wherein formations are provided on said openings through said kiln floor and respective parts of said car members which extend therethrough so as to provide a labyrinth seal therebetween.

19. An assembly according to claim 1, wherein said support means includes a plurality of beams of refractory material.

20. An assembly according to claim 19, wherein said support means includes a plurality of beams of refractory silicon carbide.

21. An assembly according to claim 19, wherein ware supports are provided locatable on one or more of said refractory beams.

22. An assembly according to claim 1, wherein at least the part of said kiln floor between the outer most said forward guide means on each side of said kiln, is formed from a plurality of sections along the length of said kiln.

23. An assembly according to claim 22, wherein means are provided to permit said sections of kiln floor to be moved relative to the rest of said kiln.

24. An assembly according to claim 23, wherein tracks are provided beneath said kiln floor, and wheels are provided upon which said sections of kiln floor are mounted, to be movable along said tracks.

25. An assembly according to claim 1, wherein said assembly comprises storage means locatable adjacent said entrance and/or exit of said kiln for respectively providing ware for firing in said kiln or receiving fired ware from said kiln.

26. An assembly according to claim 25, wherein means are provided which permit said storage means to be cooperable respectively with said loading and/or unloading means.

27. An assembly according to claim 25, wherein means are provided to render said storage means mobile.

28. An assembly according to claim 25, wherein means are provided to enable said storage means to accept a plurality of said support means located at different heights on said storage means.

29. An assembly according to claim 1, wherein heating means is provided, located on or immediately above the said kiln floor for providing heat from beneath articles to be fired.

30. An assembly according to claim 1, wherein passages are provided extending through any of said kiln floor, kiln walls or kiln ceiling, for at least part of the length of said kiln.

31. An assembly according to claim 30, wherein said passages extend from said exit of said kiln.

32. An assembly according to claim 31, wherein fans are provided substantially at said exit of said kiln or externally of said kiln, for blowing air through said passages from outside of said kiln.

33. An assembly according to claim 32, wherein combustion means are provided for said kiln, and connected to said passages such that air can be blown through any of said kiln floor, walls and/or ceiling; and heated by virtue of the high temperatures within said kiln, with the heated air being supplied to said combustion means.

34. An assembly according to claim 30, wherein said passages extend to adjacent said kiln entrance to permit warmed air to be blown on to articles entering said kiln.

35. An assembly according to claim 30, wherein said passages extend externally from said kiln whereby the warmed air may be used for heating, drying or another purpose.

36. An assembly according to claim 30, wherein valve means are provided to enable control of air flow through said respective passages.

37. An assembly according to claim 10, wherein moving means are provided for moving said first and second groups of car members through said kiln along the first and second forward guide means respectively, and said moving means comprise locating means such that consecutive said car members on the same said forward guide means locate adjacent each other but not in contact.

38. An assembly according to claim 37, wherein seal means are provided on ends of said car members such that a labyrinth seal is provided between adjacent non-contacting said car members on the same said forward guide means.

39. An assembly according to claim 1, wherein the first and second return guide means are at opposite sides respectively of said kiln.

40. An assembly according to claim 1, comprising first and second groups of car members, the first group including said first car member and being movable through the kiln along said first forward guide means and the second group including said second car member and being movable through the kiln along said second forward guide means, and wherein the first and second return guide means are at opposite sides respectively of said kiln such that the car members of the first group pass from the exit to the entrance along a first side of the kiln and the car members of the second group pass from the exit to the entrance along a second, opposite, side of the kiln.

* * * * *